US007500878B2

(12) United States Patent
Akino

(10) Patent No.: US 7,500,878 B2
(45) Date of Patent: Mar. 10, 2009

(54) MICROPHONE CONNECTOR AND METHOD OF SHIELDING THE SAME

(75) Inventor: Hiroshi Akino, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 0 days.

(21) Appl. No.: 12/113,767

(22) Filed: May 1, 2008

(65) Prior Publication Data

US 2008/0207057 A1 Aug. 28, 2008

Related U.S. Application Data

(62) Division of application No. 11/690,398, filed on Mar. 23, 2007, now Pat. No. 7,390,221.

(30) Foreign Application Priority Data

Apr. 7, 2006 (JP) ..... 2006-106045
Jan. 12, 2007 (JP) ..... 2007-004664

(51) Int. Cl.
*H01R 9/03* (2006.01)

(52) U.S. Cl. ..... 439/610; 439/108; 439/941

(58) Field of Classification Search ..... 439/98–99, 439/108, 607–610, 941
See application file for complete search history.

(56) References Cited

U.S. PATENT DOCUMENTS 3,203,769 A 8/1965 Akino et al.
4,361,375 A * 11/1982 Bailey et al. ..... 439/357
4,493,525 A 1/1985 Hall et al.
4,685,758 A * 8/1987 Yoshida ..... 439/606
4,741,708 A * 5/1988 Yoshida ..... 439/483
2005/0196000 A1 9/2005 Akino
2006/0046570 A1 3/2006 Akino
2007/0238358 A1 10/2007 Akino

FOREIGN PATENT DOCUMENTS

JP 11-155198 6/1999
JP 2002-152892 5/2002
JP 2006-61765 3/2006

* cited by examiner

*Primary Examiner*—Truc T Nguyen
(74) *Attorney, Agent, or Firm*—Oblon, Spivak, McClelland, Maier & Neustadt, P.C.

(57) ABSTRACT

A microphone connector and a method of shielding the same, the microphone connector including a crimping sleeve that covers component members inside a connector portion, the microphone connector being capable of connecting the crimping sleeve and a connector housing electrically. The microphone connector includes a crimping sleeve having a small-diameter cylindrical part and a large-diameter cylindrical part. A microphone cable has a fold-back part folded back so that a shield outer jacket covers an insulating coating. The small-diameter cylindrical part of the crimping sleeve is fitted around an outer side of the fold-back part of the shield outer jacket and is compressed to be coupled with the microphone cable. The large-diameter cylindrical part of the crimping sleeve is put on a connection portion between the cable side connector and the microphone cable. The large-diameter cylindrical part of the crimping sleeve and a connector housing engage each other via a sleeve.

5 Claims, 12 Drawing Sheets

MICROPHONE CONNECTOR AND METHOD OF SHIELDING THE SAME

CROSS-REFERENCE TO RELATED APPLICATIONS

This application is a division of and claims the benefit of priority under 35 U.S.C. §120 from U.S. patent application Ser. No. 11/690,398 filed Mar. 23, 2007, and claims the benefit of priority under 35 U.S.C. §119 from Japanese Application Nos. 2006-106045 filed Apr. 7, 2006, and 2007-004664 filed Jan. 12, 2007. The entire contents of U.S. patent application Ser. No. 11/690,398 are incorporated herein by reference.

BACKGROUND OF THE INVENTION

1. Field of the Invention

The present invention relates to connectors for use in a microphone, and in particular relates to a shielding structure and shield method against high frequency current attempting to enter from the outside.

2. Related Background of the Invention

In a microphone in which miniaturization is required, such as a certain type of microphone, e.g., a tiepin type microphone, a gooseneck type microphone, and the like, in order to make the microphone unnoticeable a low cut circuit and an output circuit are housed in a circuit housing part provided separately from a microphone unit part, and the above-described microphone unit part and circuit housing part are connected by a dedicated microphone cable. In the microphone unit part, sound is converted into an electric signal, and this sound signal is transmitted to the above-described circuit housing part to be output from the output circuit incorporated in the circuit housing part. The circuit housing part incorporating the low cut circuit and output circuit is called a power module part. In case of a condenser microphone, an impedance converter is incorporated in a microphone unit part.

The dedicated microphone cable for connecting the microphone unit part and the power module part is a two-core shielded cable. This microphone cable includes signal wires for inputting to the power module part the sound signal output from the microphone unit part, and a shield outer jacket for electrostatically shielding and grounding these wires. In case of a condenser microphone, the above-described signal wires of the microphone cable also serve as power supply wires for supplying power to the impedance converter from the outside.

Because the sound signal converted at the microphone unit part is transmitted to the power module part through the above-described dedicated microphone cable under unbalanced condition, it has a drawback of being vulnerable to noise from the outside, i.e., being susceptible to electromagnetic waves from the outside. More specifically, when electromagnetic waves reach the dedicated microphone cable from the outside, the electromagnetic waves enter the inside of the microphone unit part or the power module part through this microphone cable, and the electromagnetic waves are detected by semiconductor elements constituting the microphone unit part or the power module part, and this results in noise that will mix with the sound signal. Moreover, from the power module part the microphone output is output through a balanced shielded cable, however, if a strong electromagnetic wave reaches the microphone or an output cable of the microphone, it turns into a high frequency current and enters the inside of the microphone via the microphone connector. This current is detected by the above-described semiconductor elements, resulting in noise that will mix with the sound signal. In case of a condenser microphone, a high frequency current that is transmitted to the microphone unit part via the microphone connector is detected by the semiconductor elements constituting the impedance converter, resulting in noise, and therefore, the condenser microphone is more susceptible to electromagnetic waves.

From the microphone, more specifically from its power module part, sound signals are output through the microphone cable comprised of a balanced shielded cable as described above. The microphone cable is configured so as to be removably mounted to the microphone by a 3-pin microphone connector defined by EIAJ RC-5236 "a latch-lock round connector for audio equipment". In the 3-pin microphone connector, typically, a first pin is used for grounding, a second pin used as the hot side of a signal, and a third pin used as the cold side of a signal.

A connector attached to an ordinary microphone cable has a male connector and a female connector engaging each other for contact, wherein in at least one of the male connector and the female connector, two core wires of the microphone cable are directly connected to the second pin and third pin by soldering or the like, respectively. A shield outer jacket of the microphone cable is connected via a lead wire to the housing of the above-described connector made of metal. For this reason, there is impedance for high frequency between the shield outer jacket of the microphone cable and the connector housing, and from this part a high frequency current enters.

Conventionally, with regard to microphone-related shielding techniques, although surrounding the microphone body with a cylindrical shielding member has been proposed (for example, see Patent Document 1 and Patent Document 2), shielding the connector portion, as has been described above, has not been of major interest. For this reason, high frequency electromagnetic waves enter from the connector portion, causing noise that will mix with the sound signal.

In particular, because high frequency electromagnetic waves exist nearby everywhere due to the popularization of mobile phones and the like as in recent years, there are more chances that a high frequency signal enters from the connector portion of the microphone cable and noise enters into the sound signal. In particular, in case of a condenser microphone, the use of a mobile phone or the like near the condenser microphone presents a problem that the condenser microphone is susceptible to a high frequency signal emitted from the mobile phone and the high frequency signal entering from the connector portion is likely to become noise.

Therefore, the present inventor filed a patent regarding a microphone connector and a method of shielding the same, earlier. Here, the microphone connector includes a crimping sleeve made of shield material and having a small-diameter cylindrical part and a large-diameter cylindrical part, wherein the small-diameter cylindrical part of the crimping sleeve fits around the outer peripheral side of a fold-back part of a shield outer jacket at an end portion of a microphone cable and is compressed, and thereby the crimping sleeve is coupled with the microphone cable, and wherein the large-diameter cylindrical part of the crimping sleeve covers a connection portion between the connector and the microphone cable, so that the large-diameter cylindrical part of the crimping sleeve and the connector housing engage each other (see Patent Document 3).

[Patent Document 1] Japanese Patent Application Laid-open No. 2002-152892

[Patent Document 2] Japanese Patent Application Laid-open No. 11-155198

[Patent Document 3] Japanese Patent Application Laid-open No. 2006-61765

FIGS. 8A, 8B, 8C and 9 show an example of a microphone connector described in Patent Document 3. In FIGS. 8A, 8B, 8C and 9, reference numeral 10 represents a female connector. To the female connector 10, a male connector at a microphone (not illustrated) side is inserted to connect the female connector 10 and the male connector electrically. The female connector 10 is a so-called 3-pin type, and includes: three pins to be engaged with the male connector at the microphone side; and terminals electrically integrated with these pins and projecting from the rear end of the female connector 10. Core wires 23, 24 at one end side of a microphone cable 20 and a connection end 25 that is an extending part of a shield outer jacket are connected to the terminals each by soldering, respectively. Around the outer peripheral side of the microphone cable 20, an insulating sleeve 60 is passed, from the rear side of which is passed a crimping sleeve 30, furthermore from the rear side of which is passed a bush 40.

The insulating sleeve 60 surrounds a connection portion between the one end side of the microphone cable 20 and the female connector 10 to protect this connection portion and prevent this connection portion from shorting, and is a member having approximately the same outer diameter as that of the female connector 10.

The crimping sleeve 30 includes a small-diameter cylindrical part 32 and a large-diameter cylindrical part 31, and between the small-diameter cylindrical part 32 and the large-diameter cylindrical part 31 there is formed a step extending radially. The crimping sleeve 30 is made of conductive material and functions as a shielding member. The large-diameter cylindrical part 31 surrounds, with a certain spatial allowance, a connection portion between the one end side of the microphone cable 20 and the female connector 10 and has approximately the same outer diameter as that of the insulating sleeve 60. The inner diameter of the small-diameter cylindrical part 32 is slightly larger than the outer diameter of the microphone cable 20. At the one end of the microphone cable 20, the shield outer jacket put on the outside of the core wires 23 and 24 is folded back outwardly, so that the shield outer jacket is put on an insulating coating of the microphone cable 20 to form a fold-back part 21 of the shield outer jacket. Around the outside of the fold-back part 21 of the shield outer jacket is passed the small-diameter cylindrical part 32 of the crimping sleeve 30, and by compressing this cylindrical part 32, the crimping sleeve 30 and the above-described shield outer jacket are electrically connected and the crimping sleeve 30 is coupled with the microphone cable 20.

The bush 40 includes a root part 41 having an inner diameter slightly larger than the outer diameter of the microphone cable 20, and a cover part 42 capable of covering the crimping sleeve 30 and having a diameter larger than the root part 41. The female connector 10 is engaged with the inner peripheral side of a cylindrical connector housing 50. The connector housing 50 has a length enough to cover the female connector 10, the insulating sleeve 60, and the large-diameter cylindrical part 31 of the crimping sleeve 30. The rear end outer circumference of the connector housing 50 is configured to fit into the front end inner circumference of the bush 40.

FIGS. 8A, 8B, and 8C show the order of assembly, and FIGS. 8C and 9 each show a cross section of the connector portion when the assembly is completed. As shown in FIG. 8A, the microphone cable 20 is connected to the female connector 10 by soldering each wire of the microphone cable 20 to each terminal of the female connector 10. After this soldering or before this soldering, the insulating sleeve 60 and crimping sleeve 30 are passed through the microphone cable 20, and as shown in FIG. 8B, the front end of the insulating sleeve 60 is butted against the rear end of the female connector 10. Moreover, around the rear end outer circumference of the insulating sleeve 60 is fitted the front end inner circumference of the large-diameter cylindrical part 31 of the crimping sleeve 30, and at the same time the small-diameter cylindrical part 32 of the crimping sleeve 30 is fitted around the fold-back part 21 of the shield outer jacket of the microphone cable 20 so as to surround this from the outside. Then, the small-diameter cylindrical part 32 of the crimping sleeve 30 is compressed from the outer peripheral side to couple the crimping sleeve 30 with the microphone cable 20 and at the same time to connect the shield outer jacket of the microphone cable 20 and the crimping sleeve 30 so as to be electrically integrated.

Then, as shown in FIGS. 8C and 9, the female connector 10, the insulating sleeve 60, and the rear end outer circumference of the connector housing 50 put on the large-diameter cylindrical part 31 of the crimping sleeve 30 are engaged with the front end inner circumference of the bush 40 to thereby integrate the connector housing 50 with the bush 40. This constitutes a connector portion at the female side, wherein the female connector 10, the insulating sleeve 60, the crimping sleeve 30, and the microphone cable 20 are integrally coupled along with the connector housing 50 and the bush 40.

According to a microphone connector of Patent Document 3 described above, the connection portion between the female connector 10 and the microphone cable 20 is covered with the large-diameter cylindrical part 31 of the crimping sleeve 30, and the small-diameter cylindrical part 32 of the crimping sleeve 30 is engaged with the outer peripheral side of the fold-back part 21 of the shield outer jacket at the end of the microphone cable 20 and is also compressed to be electrically connected with the shield outer jacket of the microphone cable 20 and moreover the large-diameter cylindrical part 31 of the crimping sleeve 30 and the connector housing 50 engage each other. Accordingly, the connection portion between the female connector 10 and the microphone cable 20 is shielded continuously from the shield outer jacket of the microphone cable 20 to the connector housing 50, thus increasing the shield effect of the connection portion between the female connector 10 and the microphone cable 20. Moreover, the connection portion between the female connector 10 and the microphone cable 20 is covered with the crimping sleeve 30 of the integral structure having the small-diameter cylindrical part 32 and the large-diameter cylindrical part 31, the small-diameter cylindrical part 32 is electrically connected to the shield outer jacket of the microphone cable 20 by compression, and the large-diameter cylindrical part 31 is electrically connected by the engagement with the connector housing 50. Accordingly, a connection from the shield outer jacket of the microphone cable 20 to the connector housing 50 is made electrically reliably and there is no open portion (opening) of the shield, thus contributing to an improvement in the shield effect of the above-described connection portion. Because the step extending radially is formed between the small-diameter cylindrical part 32 and the large-diameter cylindrical part 31 of the crimping sleeve 30, the above-described step shields effectively high frequency signals attempting to enter from the outside, thus contributing to an improvement in the shield effect of the above-described connection portion also from this point.

Because the small-diameter cylindrical part 32 of the crimping sleeve 30 is compressed at the fold-back part 21 of the shield outer jacket of the microphone cable 20, the shield outer jacket of the microphone cable 20 and the crimping sleeve 30 are connected reliably, thereby allowing the electrical contact resistance to be reduced, thus contributing to an improvement in the shield effect of the above-described connection portion also from this point.

SUMMARY OF THE INVENTION

[Problem to be Solved by the Invention]

According to the invention described in Patent Document 3, an excellent effect described above can be obtained, however, in order to obtain such desired effect the large-diameter part of the crimping sleeve needs to fit, without any gap, in the inner diameter of the connector housing. This is because if there is a gap between the large-diameter part of the crimping sleeve and the inner diameter of the connector housing, high frequency signals will enter the inside through this gap. However, if attempting to eliminate the above-described gap, the outside dimension of the large-diameter part of the crimping sleeve and the inner diameter size of the connector housing need to be machined with sufficient accuracy, thus increasing the machining cost. Moreover, if attempting to machine with sufficient accuracy and fit the above-described both without any gap, the assembly will be difficult. If the gap is increased, the contact between the both becomes unstable and thus the shielding becomes imperfect. Because the connector housing is generally made by aluminum casting and has a large variation in dimensions, the connector housing has a drawback in that the gap between the crimping sleeve and the connector housing tends to increase and thus the shielding is likely to be imperfect as described above.

Moreover, according to the invention described in Patent Document 3, in the case where the type of microphone is a condenser microphone in which the power of an impedance converter is supplied from a phantom power supply using a commercial alternating current power, or a vacuum tube type microphone to which the power is supplied from a commercial alternating current power, the power supply path serves also as the sound output cable and additionally the output cable is connected to a mixer that uses the commercial alternating current power, thereby presenting a problem that ham noise due to a ground loop will occur.

FIG. 10 illustrates an example of the ground loop occurring in the microphone cable having a phantom power supply interposed in the middle thereof. In FIG. 10, a microphone 80 is connected to a power module part 84 via a microphone cable 81, a phantom power supply 82, and a microphone cable 83. The microphone cables 81 and 83 include two core wires, which are signal wires, a conductive shield outer jacket that surrounds these core wires from the outside of its insulating coating, and an insulating coating that surrounds the shield outer jacket from the outside. The phantom power supply 82 includes a standard connector as described above, which is designed to connect the microphone cables 81 and 83 to each other. A case 87 of the phantom power supply 82 is made of conductive material, and the shield outer jacket of the microphone cable is connected to this case 87, and the case 87 of the phantom power supply 82 is grounded. This is denoted by a grounding point 85. Also in the power module part 84, its chassis or a ground circuit pattern of the circuit board is grounded. This is denoted by a grounding point 86. In addition, the power module part 84 may be a microphone amplifier or a mixer as the alternative, or may be its own dedicated power supply in case of a vacuum tube microphone.

In this way, the case 87 of the phantom power supply 82, the chassis of the power module part 84, and the like are grounded for the purpose of conducting electromagnetic waves from the commercial alternating current power or electromagnetic waves from various kinds of appliances to the earth and thereby preventing inductive noise due to the electromagnetic waves from entering a signal wire. However, inductive noise may not be removed though being grounded as described above. The reason is as follows. The wiring as shown in FIG. 10 provides a ground loop 89 that is electrically conducted in the order from the case 87 of the phantom power supply 82=>the grounding point 85=>ground =>the grounding point 86=>the chassis of the power module part 84 or a ground circuit pattern of the circuit board =>the shield outer jacket of the microphone cable. If electromagnetic waves enter this ground loop 89, electrical current will flow in the ground loop 89 and a voltage will occur due to a resistor of the ground loop 89. This voltage turns into the inductive noise voltage to mix in the signal wire. In this way, even if the ground loop 89 conducts the inductive noise captured by the shield outer jacket of the microphone cable to the ground, the noise will be circulated, causing an inductive noise voltage, so called ham noise.

Consequently, a measure may be taken in which a ground lift switch is provided in a phantom power supply case of a condenser microphone, or in a power supply case of a vacuum tube microphone, and when ham noise occurs, the internal circuit of the power module part 84 or the like, and above-described power supply case are electrically cut off from each other by means of the ground lift switch. Moreover, there may be taken a measure in which the connection to the first pin, to which the phantom power supply case and the shield outer jacket of the microphone cable are connected, is cut off.

However, these measures disable grounding, though the phantom power supply case, the power module part, and the like are grounded in order to conduct the entered electromagnetic waves to ground and thereby prevent the inductive noise from mixing with the sound signal, and therefore these measures are not fundamental countermeasures against electromagnetic waves and have complexity that a certain switch must be operated.

As a means to solve such problems, a technique has been put in practical use in which a path between the connector case or the phantom power supply case, and the shield outer jacket of the microphone cable is bypassed by a capacitor to thereby prevent high frequency current from entering the inside, thus cutting off the ground loop by means of the capacitor. FIG. 11 shows an example in which capacitors 90 are connected between the case 87 of the phantom power supply 82 and the shield outer jacket of the microphone cable 81. Reference numeral 88 represents a ferrite bead. The ferrite bead 88 acts as an inductor in a high frequency region.

FIG. 12 shows an example in which the above-described shield structure is employed also between the phantom power supply 82 and the other microphone cable 83. As apparent from FIG. 12, although the case of the phantom power supply 82 is connected to the grounding point 86, the capacitors 90 are connected between the case of the phantom power supply 82 and the shield outer jacket of the microphone cables 81 and 83, thereby preventing the ground loop 89 as shown in FIG. 10 from being generated.

If the problem of the ground loop 89 shown in FIG. 10 does not exist, it is also effective to ground the shield outer jackets of the microphone cables 81 and 83 through the case 87 of the phantom power supply 82 as shown in FIG. 10. Moreover, if the problem of the ground loop 89 exists, it is also effective to bypass the path between the case 87 of the phantom power supply 82 and the shield outer jackets of the microphone cables 81 and 83 by means of the capacitors 90 like in the examples shown in FIG. 11 and FIG. 12. Which one among these to choose varies depending on various conditions and is determined by the individual connector and the microphone to be combined therewith. Accordingly, for example, there may be cases where which to choose has to be determined while testing the above two cases in a field to use the microphone, and thus it is preferable that the above-described two cases can be switched easily.

However, in order to switch between the configuration shown in FIG. 10 and that shown in FIG. 11 and FIG. 12, the connection has to be switched by connecting between the case 87 of the phantom power supply 82 and the shield outer jackets of the microphone cables 81 and 83, or by disconnecting these and then connecting the capacitor 90 therebetween, and so on. In order to do so, the connection switching by soldering is required and thus this switching operation is extremely troublesome.

The present invention has been made to dissolve the problems of the conventional examples described above, and is intended to provide a microphone connector and a method of shielding the same, the microphone connector with a crimping sleeve covering component members inside a connector portion, wherein even if the dimensional accuracy of the crimping sleeve and the connector case is not high, the microphone connector is capable of connecting electrically reliably between the crimping sleeve and the connector case and thereby preventing the entry of electromagnetic waves, and wherein the assembly is also easy.

The present invention is also intended to provide a microphone connector and a method of shielding the same, the microphone connector being capable of switching easily between a configuration in which the connector case and the shield outer jacket of the microphone cable are connected, and a configuration in which a bypass capacitor is interposed between the connector case and the shield outer jacket of the microphone cable.

[Means for Solving the Problems]

A microphone connector according to the present invention, includes: a microphone cable having a shield outer jacket put on an outside of a core wire, and an insulating coating for covering the shield outer jacket; a cable side connector to which the core wire and the shield outer jacket of the microphone cable are connected and which can couple a microphone side connector; a connector housing which covers the cable side connector; and a crimping sleeve made of shield material having a small-diameter cylindrical part and a large-diameter cylindrical part, wherein: the microphone cable has a fold-back part which is folded back so that the shield outer jacket covers an outer surface of the insulating coating at a connection end portion with the connector; the small-diameter cylindrical part of the crimping sleeve is fitted around an outer peripheral side of the fold-back part of the shield jacket at an end of the microphone cable and is compressed to couple the crimping sleeve with the microphone cable; the large-diameter cylindrical part of the crimping sleeve is put on a connection portion between the cable side connector and the microphone cable; and the large-diameter cylindrical part of the crimping sleeve and the connector housing engage each other via a conductive sleeve made of elastic material and having a waveform-shaped longitudinal cross section.

In place of the above-described conductive sleeve, a capacitor sleeve may be used in which a metal face is formed on the right side and rear side of a plastic film having a waveform-shaped longitudinal cross section, respectively.

In place of the above-described conductive sleeve, an elastic conductive cloth ring may be compressed and interposed between the crimping sleeve and the connector housing.

[Advantages of the Invention]

Since the large-diameter cylindrical part of the crimping sleeve and the connector housing engage each other via the conductive sleeve made of elastic material and having a waveform-shaped longitudinal cross section, the conductive sleeve made of elastic material and having a waveform-shaped longitudinal cross section connects the crimping sleeve and the connector housing at a plurality of points electrically integrally to thereby shield the inside of the connector reliably. Moreover, the conductive sleeve can fill a gap between the crimping sleeve and the connector housing even if the dimensional accuracy of the crimping sleeve and the connector housing is not high, and therefore, exact dimensional accuracy is not required and the assembly is also easy.

The same advantage can be obtained even if in place of the above-described conductive sleeve an elastic conductive cloth ring is compressed and interposed between the crimping sleeve and the connector housing.

If the above-described ground loop occurs and causes ham noise by using the above-described conductive sleeve, in place of the conductive sleeve a capacitor sleeve may be used in which a metal face is formed on the right side and rear side of a plastic film having a waveform-shaped longitudinal cross section, respectively. By using the capacitor sleeve, the ground loop can be cut off and a high frequency current can be conducted from the shield outer jacket of the microphone cable to the connector housing via the capacitor sleeve.

Moreover, there is also an advantage that the conductive sleeve and the capacitor sleeve can be exchanged easily by removing the coupling between the connector housing and the bush and it is possible to change easily to the conductive sleeve specification and the capacitor sleeve specification depending on the use condition.

BRIEF DESCRIPTION OF THE DRAWINGS

FIG. 10 is a wiring diagram showing an example of forming a ground loop in the connection of a microphone.

FIG. 11 is a model diagram showing a configuration example of a connector for cutting off the ground loop.

FIG. 12 is a wiring diagram showing an example of microphone connection using the connector for cutting off the above-described ground loop.

DESCRIPTION OF THE PREFERRED EMBODIMENTS

Figure 8A:
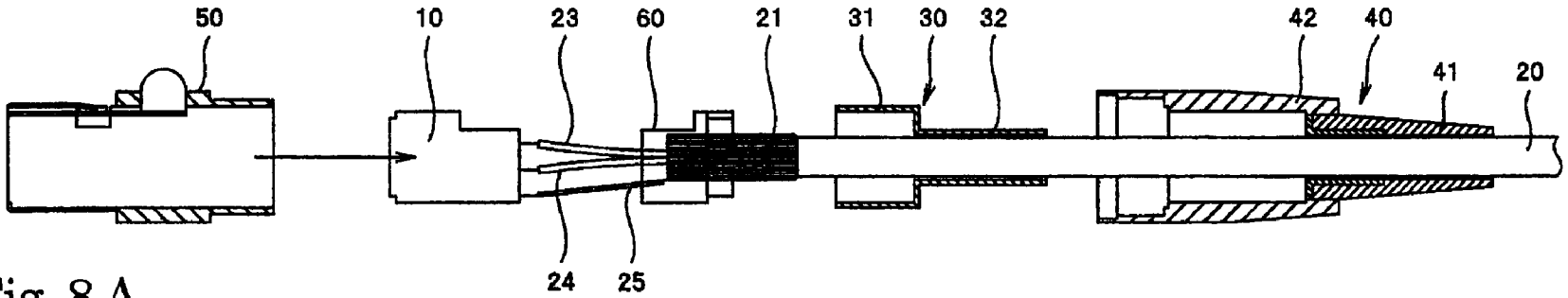
FIG. 8A is a longitudinal cross sectional view showing an initial stage of an assembly process of an example of a conventional microphone connector.
Figure 8B:
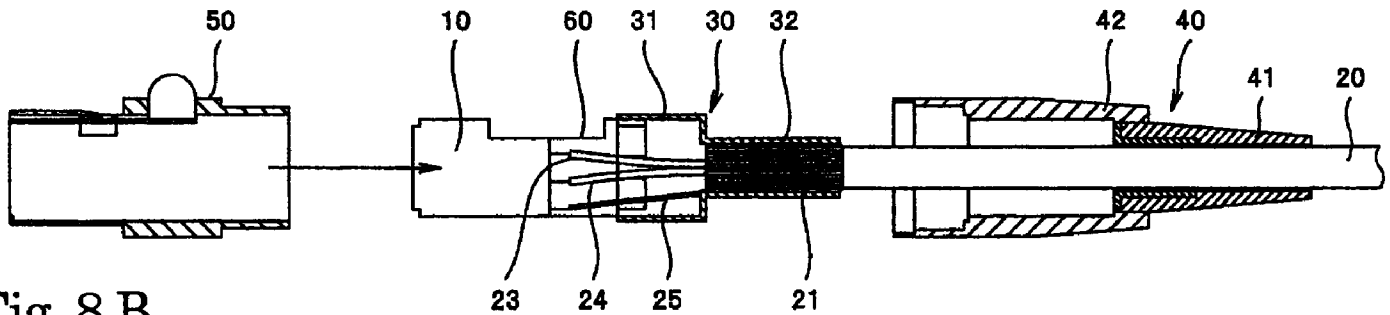
FIG. 8B is a longitudinal cross sectional view showing an assembly process following the step shown in FIG. 8A of the conventional example.
Figure 8C:
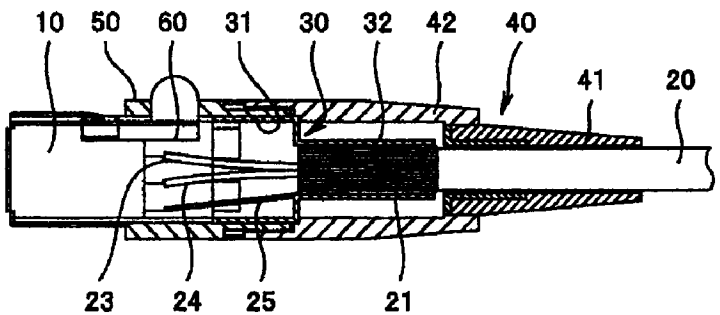
FIG. 8C is a longitudinal cross sectional view showing a state where the assembly of the conventional example is completed.
Figure 9:
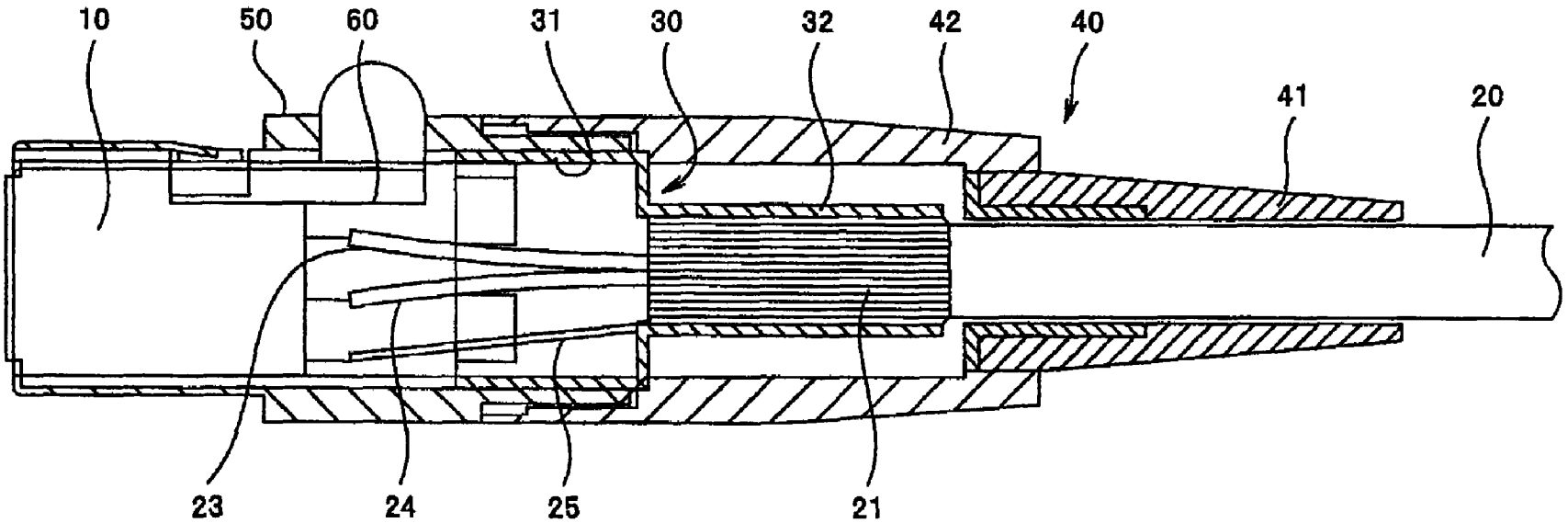
FIG. 9 is a cross sectional view showing the enlarged assembly state of the conventional example of the microphone connector.

Hereinafter, with reference to the accompanying drawings, embodiments of a microphone connector and a method of shielding the same according to the present invention will be described. In addition, the same reference numerals are given to the same components as those of the conventional example of the microphone connector shown in FIG. 8 and FIG. 9.

Embodiment 1

Figure 1A:
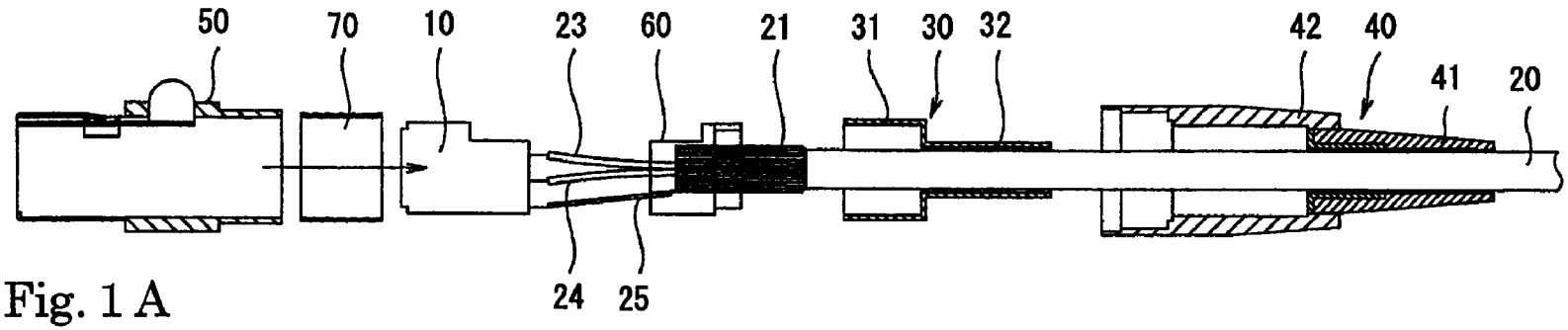
FIG. 1A is a longitudinal cross sectional view showing an initial stage of an assembly process of Embodiment 1 of a microphone connector according to the present invention.
Figure 1B:
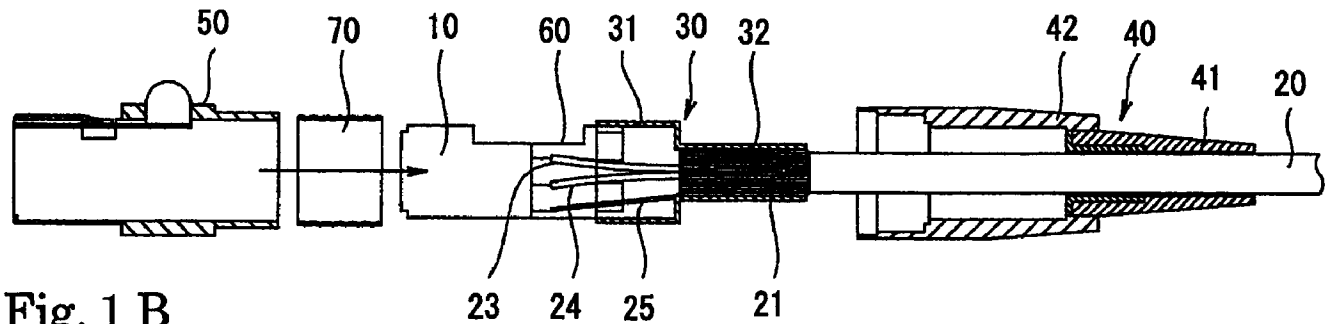
FIG. 1B is a longitudinal cross sectional view showing an assembly process following the step shown in FIG. 1A of Embodiment 1.
Figure 1C:
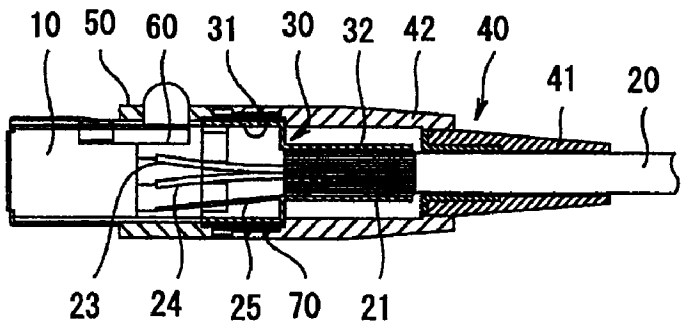
FIG. 1C is a longitudinal cross sectional view showing a state where the assembly of Embodiment 1 is completed.
Figure 2:
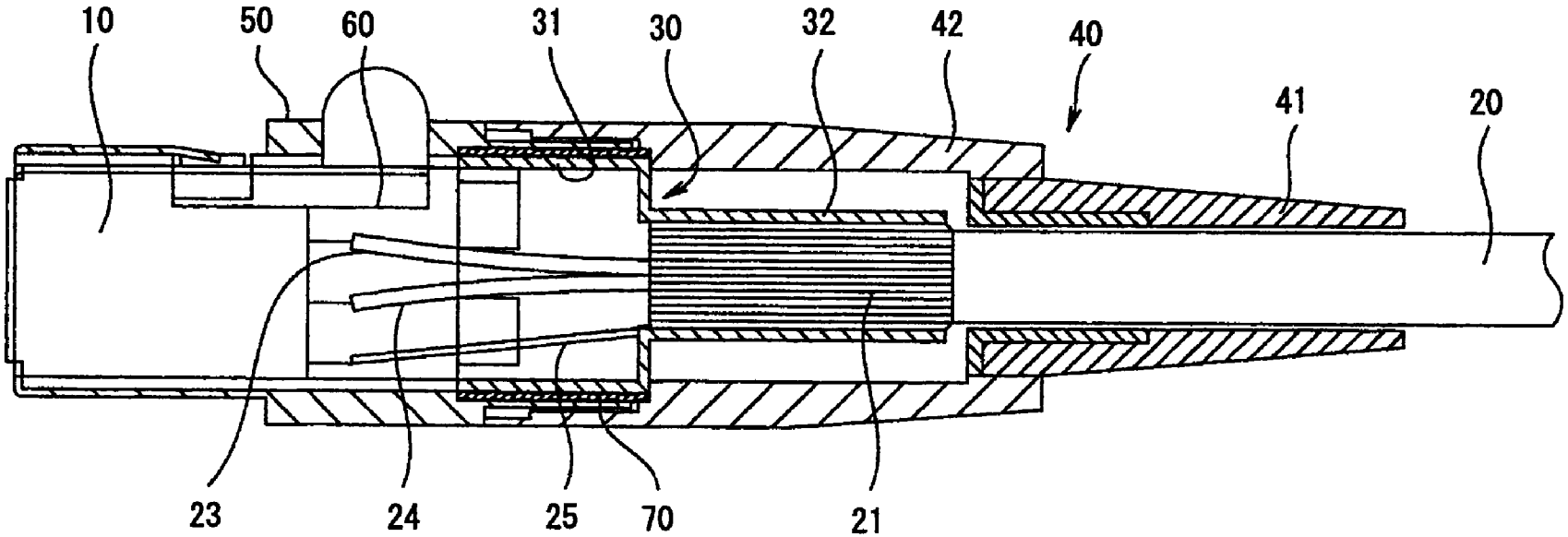
FIG. 2 is a longitudinal cross sectional view showing the enlarged state where the microphone connector according to the above-described embodiment is completed.
Figure 1:
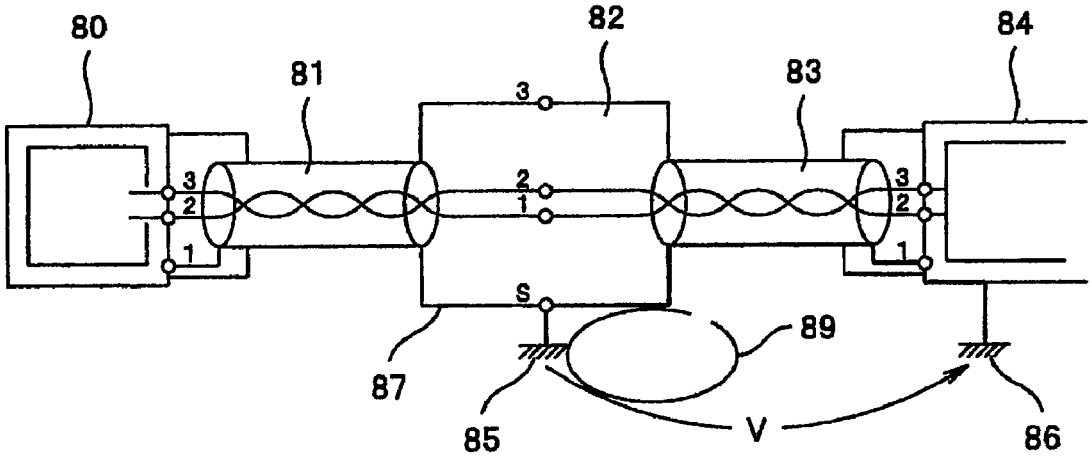
Figure 1:
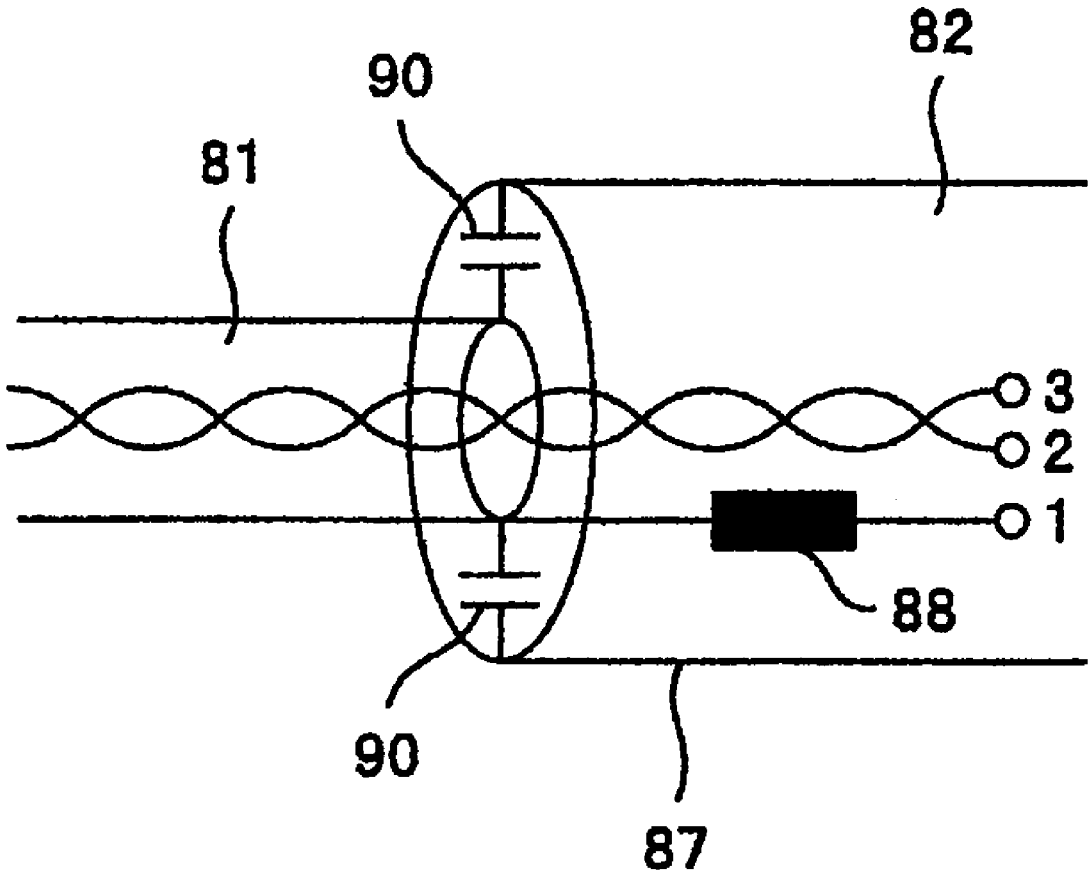
Figure 1:
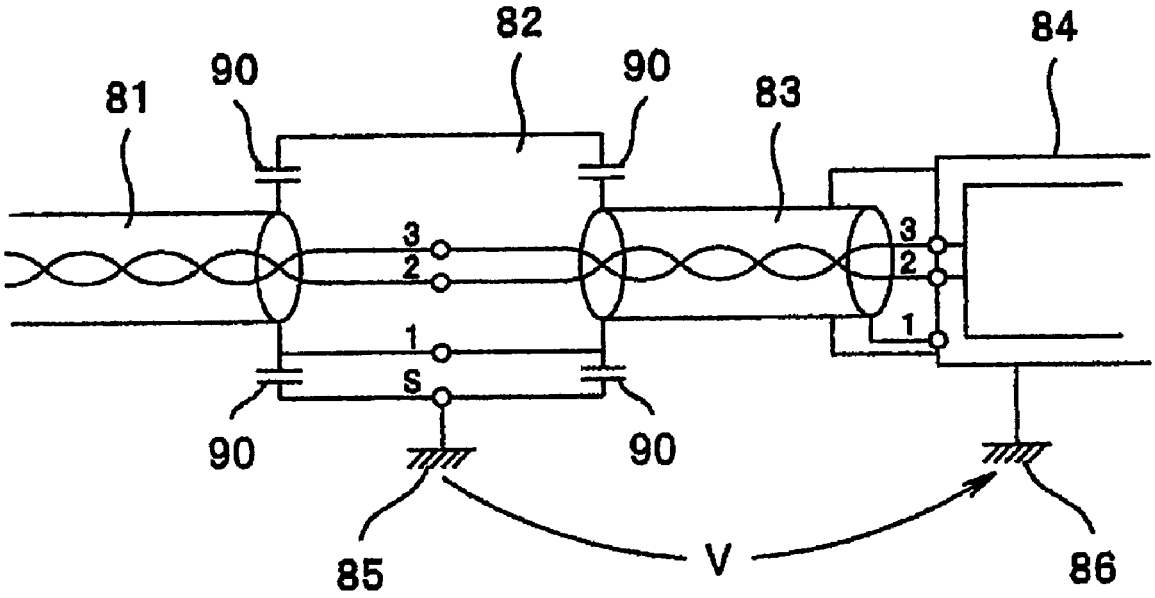

In FIG. 1 and FIG. 2, reference numeral 10 represents a female connector. To the female connector 10, a male connector at the microphone (not illustrated) side can be inserted, so that the female connector 10 and the male connector are electrically connected. The female connector 10 is the so-called 3-pin type, and includes, three pins engaging the male connector at the microphone side, and terminals electrically integrated with these pins, the terminals projecting from the rear end (the right end in the view) of the female connector 10. To each of the terminals, the core wires 23 and 24 and the shield outer jacket at one end of the microphone cable 20 are electrically connected by soldering, respectively.

Figure 4:
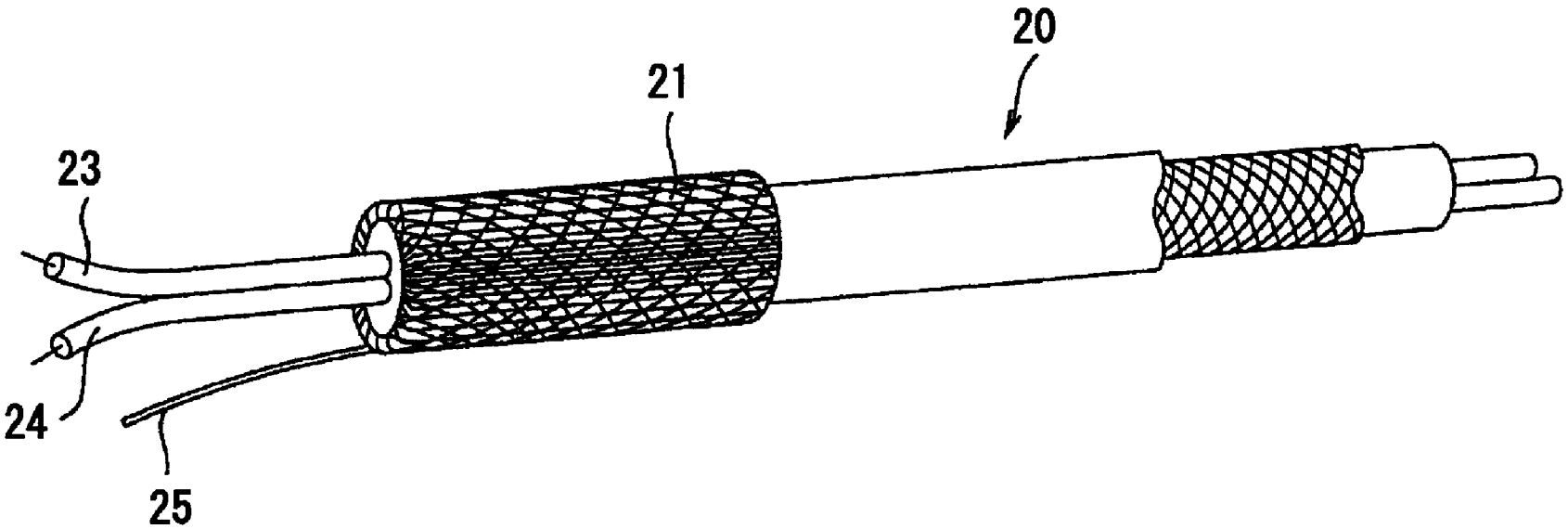
FIG. 4 is a perspective view showing a structure of the end portion of the above-described microphone cable in the above-described embodiment.

As shown in FIG. 4, the microphone cable 20 includes the core wires 23, 24, the shield outer jacket put on insulation material of the outside of these core wires, and an insulating coating for covering this shield outer jacket. Moreover, the microphone cable 20 is provided with a fold-back part 21 which is folded back so that the shield outer jacket covers an outer surface of the insulating coating at a connection end portion with the female connector 10. The above-described shield outer jacket is sack-like with a large number of conductive thin wires being intertwined regularly or irregularly, and this sack-like part is put on the insulation material on the outer side of the core wires. Then, by folding back the sack-like part of the shield outer jacket, the fold-back part 21 is provided, and a part of the shield outer jacket constituting the sack-like part is extended towards the female connector 10 direction, without being folded back, and this part serves as the connection end 25 of the shield outer jacket. This connection end 25 is connected to a predetermined terminal of the female connector 10 by soldering.

As shown in FIG. 1C and FIG. 2, around the outer peripheral side at one end of the microphone cable 20 is passed the insulating sleeve 60, from the rear side of which is passed the crimping sleeve 30, furthermore from the rear side of which is passed the bush 40.

The insulating sleeve 60 surrounds a connection portion between the one end side of the microphone cable 20 and the female connector 10 to thereby protect the connection portion and also prevent this connection portion from contacting and shorting to the connector housing 50. The outer diameter of the insulating sleeve 60 is approximately the same as that of the female connector 10.

Figure 3:
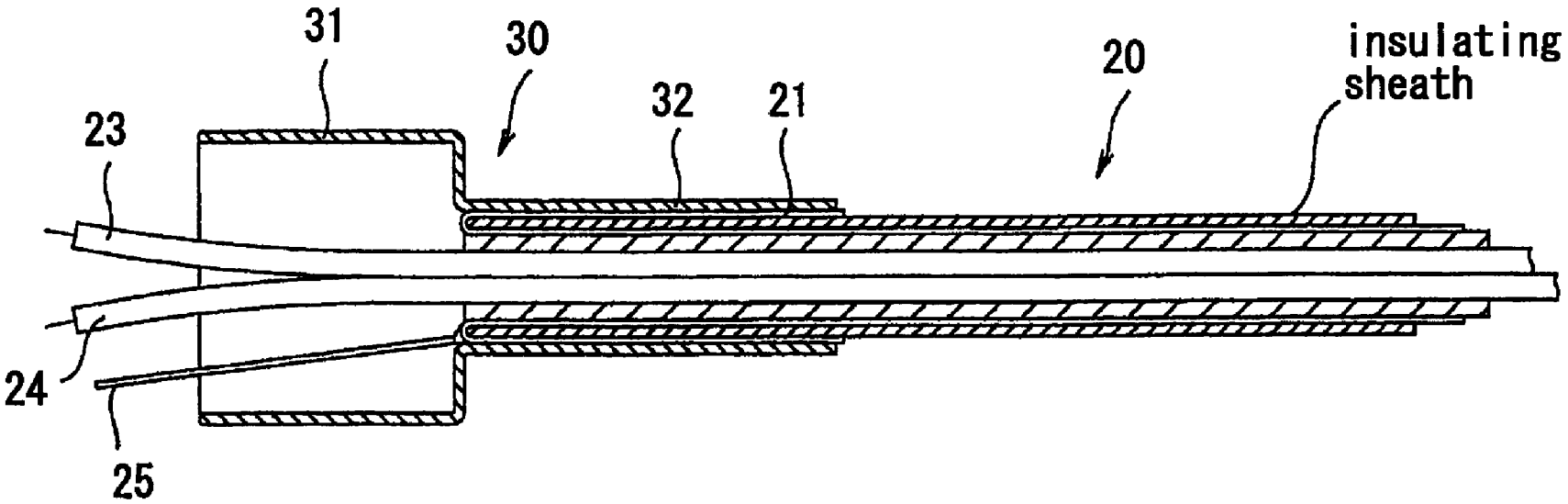
FIG. 3 is a longitudinal cross sectional view showing a state where a crimping sleeve is fitted around an end portion of a microphone cable.

As shown also in FIG. 3, the crimping sleeve 30 includes the small-diameter cylindrical part 32 and the large-diameter cylindrical part 31, and between the small-diameter cylindrical part 32 and the large-diameter cylindrical part 31 there is formed a step extending radially. The crimping sleeve 30 is made of conductive material and functions as a shielding member. The large-diameter cylindrical part 31 surrounds, with a certain spatial allowance, the connection portion between the one end side of the microphone cable 20 and the female connector 10. The outer diameter of the large-diameter cylindrical part 31 is smaller than the inner diameter of the connector housing 50. Although the outer diameter of the large-diameter cylindrical part 31 is fitted in the inner diameter side of the connector housing 50, there is a gap between the outer peripheral face of the large-diameter cylindrical part 31 and the inner peripheral face of the connector housing 50, and a conductive sleeve 70 is interposed in this gap. That is, the large-diameter cylindrical part 31 of the crimping sleeve 30 and the connector housing 50 engage each other via the conductive sleeve 70.

Figure 5A:
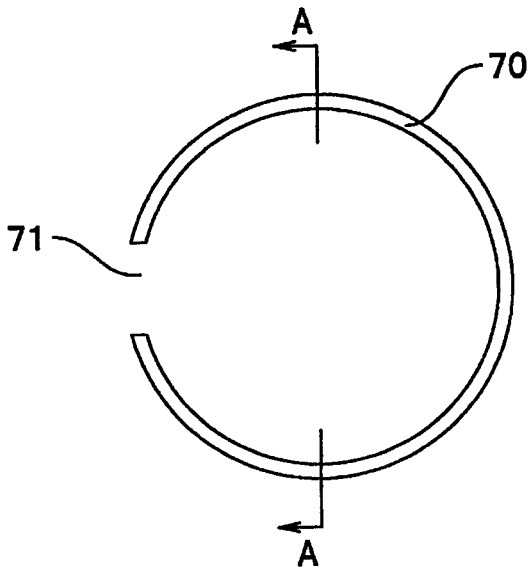
FIG. 5A is a side view showing an example of a conductive sleeve used in a microphone connector according to the present invention.
Figure 5B:
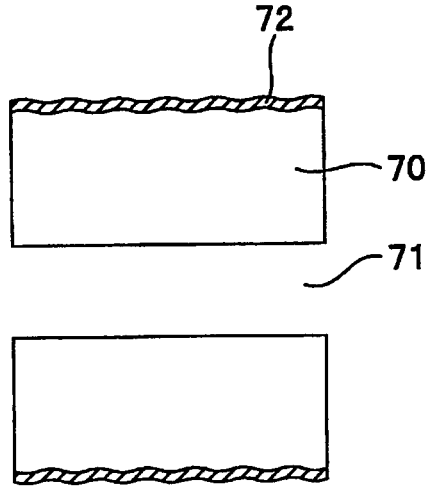
FIG. 5B is a cross sectional view taken along a line A-A in FIG. 5A.

As shown in FIG. 5A and FIG. 5B, the conductive sleeve 70 has a waveform-shaped longitudinal cross section and is made of elastic material, and a part of the cylinder is removed along the central axis line to form a slit 71, and thereby the cross sectional shape is formed in a C-shape so that the conductive sleeve 70 can expand or contract by elastic force.

The inner diameter of the small-diameter cylindrical part 32 of the crimping sleeve 30 is slightly larger than the outer diameter of the microphone cable 20. At the one end part of the female connector 10 side of the microphone cable 20, the shield outer jacket is folded back to the outside as described above, so that the shield outer jacket is put on the insulating coating of the microphone cable 20 to form the fold-back part 21 of the shield outer jacket. Around the outer part of the fold-back part 21 of this shield outer jacket is passed the small-diameter cylindrical part 32 of the crimping sleeve 30, and by compressing this cylindrical part 32, the crimping sleeve 30 and the shield outer jacket are electrically connected and the crimping sleeve 30 is physically coupled with the microphone cable 20.

The bush 40 includes: a root part 41 having a inner diameter slightly larger than the outer diameter of the microphone cable 20 and having the outer circumference formed in a tapered shape; and a cover part 42 capable of covering the crimping sleeve 30 and having the diameter larger than the root part 41. The bush 40 covers the whole crimping sleeve 30. The female connector 10 is fitted in the inner peripheral side of the cylindrical connector housing 50 made of conductive material. The connector housing 50 has a length enough to cover the female connector 10, the insulating sleeve 60, and the large-diameter cylindrical part 31 of the crimping sleeve 30. The rear end outer circumference of the connector housing 50 is configured to fit in the front end inner circumference of the bush 40.

FIG. 1A, FIG. 1B, and FIG. 1C show the assembly order in this order, and FIG. 1C and FIG. 2 each show a cross section of the connector portion when the assembly is completed. As shown in FIG. 1A, to each terminal of the female connector 10, each wire of the microphone cable 20 including the connection end 25 of the shield outer jacket of the microphone cable 20 is soldered to thereby connect the microphone cable 20 to the female connector 10. After this soldering or before this soldering, around the microphone cable 20 is passed the insulating sleeve 60 and the crimping sleeve 30, and as shown in FIG. 1B, the front end of the insulating sleeve 60 is butted against the rear end of the female connector 10. Moreover, the front end inner circumference of the large-diameter cylindrical part 31 of the crimping sleeve 30 is fitted around the rear end outer circumference of the insulating sleeve 60, and at the same time the small-diameter cylindrical part 32 of the crimping sleeve 30 is fitted around the fold-back part 21 of the shield outer jacket of the microphone cable 20 so as to surround the same. Next, the small-diameter cylindrical part 32 of the crimping sleeve 30 is compressed from the outer peripheral side, so that the crimping sleeve 30 is physically coupled with the microphone cable 20 and the shield outer jacket of the microphone cable 20 and the crimping sleeve 30 are connected so as to be electrically integrated.

Next, as shown in FIG. 1C and FIG. 2, the female connector 10, the insulating sleeve 60, the large-diameter cylindrical part 31 of the crimping sleeve 30, and the rear end outer circumference of the connector housing 50 covering the conductive sleeve 70 are fitted in the front end inner circumference of the bush 40 to thereby integrate the connector housing 50 with the bush 40. The large-diameter cylindrical part 31 of the crimping sleeve 30 fits in the inner circumference of the connector housing 50 via the conductive sleeve 70, and the shield outer jacket of the microphone cable 20 is electrically connected to the connector housing 50 via the crimping sleeve 30 and the conductive sleeve 70. This constitutes a connector portion at the female side, wherein the female connector 10, the insulating sleeve 60, the crimping sleeve 30, the conductive sleeve 70, and the microphone cable 20 are physically integrally coupled along with the connector housing 50 and the bush 40.

According to Embodiment 1 described above, the connection portion between the connector 10 and the microphone cable 20 is covered with the large-diameter cylindrical part 31 of the crimping sleeve 30, and the small-diameter cylindrical part 32 of the crimping sleeve 30 is fitted around the outer peripheral side of the fold-back part 21 of the shield outer jacket at the end of the microphone cable 20 and is compressed from the outer peripheral side to be electrically connected to the shield outer jacket of the microphone cable 20, and also the large-diameter cylindrical part 31 of the crimping sleeve 30 engages the connector housing 50 via the conductive sleeve 70. For this reason, the connection portion between the connector 10 and the microphone cable 20 is shielded continuously from the shield outer jacket of the microphone cable 20 to the connector housing 50, thus increasing a shield effect of the connection portion between the connector 10 and the microphone cable 20.

Moreover, the connection portion between the connector 10 and the microphone cable 20 is covered with the crimping sleeve 30 of the integral structure having the small-diameter cylindrical part 32 and the large-diameter cylindrical part 31, and the small-diameter cylindrical part 32 is compressed and thereby connected to the shield outer jacket of the microphone cable 20 and the large-diameter cylindrical part 31 is electrically connected to the connector housing 50. Accordingly, a connection from the shield outer jacket of the microphone cable 20 to the connector housing 50 is made electrically reliably, and there is no opening (open portion) of the shield, thus contributing to an improvement in the shield effect of the above-described connection portion.

Furthermore, because the large-diameter cylindrical part 31 of the crimping sleeve 30 and the connector housing 50 engage each other via the conductive sleeve 70 made of elastic material having a waveform-shaped longitudinal cross section, the conductive sleeve 70 connects the crimping sleeve 30 and the connector housing 50 electrically integrally at a plurality of points or wires to thereby shield the inside of the connector reliably. Moreover, the conductive sleeve 70 can fill the gap between the crimping sleeve 30 and the connector housing 50 even if the dimensional accuracy of the crimping sleeve 30 and the connector housing 50 is not high, and therefore exact dimensional accuracy is not required and thus the assembly is also easy.

Embodiment 2

Figure 6A:
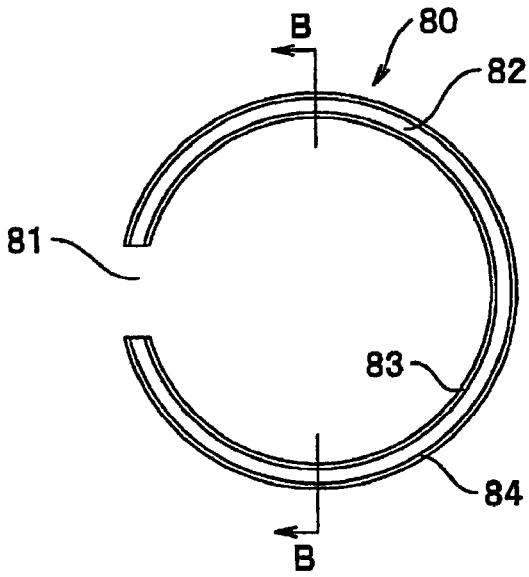
FIG. 6A is a side view showing an example of a conductive sleeve used in Embodiment 2 of the microphone connector according to the present invention.
Figure 6B:
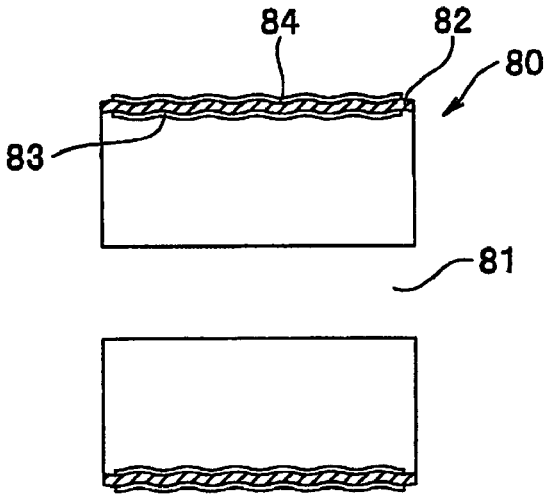
FIG. 6B is a cross sectional view taken along a line B-B in FIG. 6A.

Next, Embodiment 2 will be described. Most part of structure of Embodiment 2 is the same as that of Embodiment 1 except that a capacitor sleeve 80 as shown in FIG. 6A and FIG. 6B is used in place of the conductive sleeve 70 in Embodiment 1. In the capacitor sleeve 80, metal faces 84 and 83 are formed on the right side and rear side of a plastic film 82 having a waveform-shaped longitudinal cross sectional shape, respectively, and these metal faces 84 and 83 sandwich the plastic film 82 to form a capacitor structure. The capacitor sleeve 80 is composed of the plastic film 82 as the base, and has elasticity by forming the metal faces 84 and 83 on the right side and rear side of the plastic film 82 by a technique such as metal deposition, for example. Moreover, like in the conductive sleeve 70 in Embodiment 1, a part of the cylinder is removed along the central axis line to form a slit 81, and thereby the cross sectional shape is formed in a C-shape, allowing for expansion and contraction by elastic force.

In Embodiment 2, the assembly is carried out by the same assembly procedure as that of Embodiment 1, and in place of the conductive sleeve 70 in Embodiment 1 the capacitor sleeve 80 is interposed between the outer circumference of the large-diameter part 31 of the crimping sleeve 30 and the inner circumference of the connector housing 50. Since the capacitor sleeve 80 itself forms a capacitor, the capacitor is interposed between the large-diameter part 31 of the crimping sleeve 30 and the connector housing 50. Accordingly, in case of Embodiment 2, the ground loop described in FIG. 11 will be cut off, a high frequency current is conducted to the connector housing 50 via the capacitor sleeve 80, and thus the inside of the connector is shielded from high frequency current.

When the ground loop is formed by grounding the connector housing 50, the power module portion to which the microphone cable are connected and the like, and thereby the ground loop causes ham noise and the like, the ham noise and the like can be removed by employing the structure of Embodiment 2. Which is better to employ, the structure of Embodiment 1 or the structure of Embodiment 2, varies depending on various conditions, and therefore, it is preferable that the structure of Embodiment 1 and the structure of Embodiment 2 can be switched easily. In this respect, according the present invention, if the connector housing 50 is removed from the bush 40, the conductive sleeve 70 or the capacitor sleeve 80 is exposed, so this is replaced with the capacitor sleeve 80 or the conductive sleeve 70 and then the connector housing 50 is engaged with the bush 40 again, thereby allowing for switching to the microphone connector of a different specification. In this way, the sleeve interposed between the members just needs to be exchanged and the specification change by soldering as in the past is not required, and thus there is an advantage that specification change is easy.

Embodiment 3

Figure 7A:
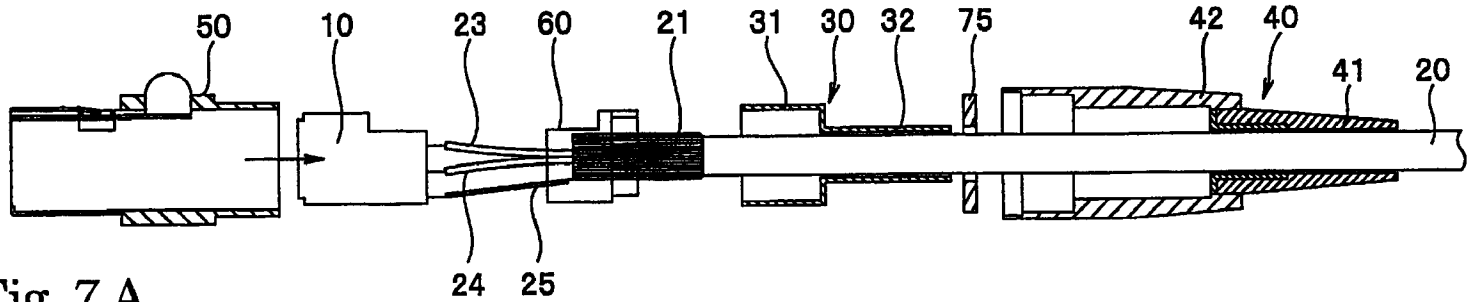
FIG. 7A is a longitudinal cross sectional view showing an initial stage of an assembly process of Embodiment 3 of the microphone connector according to the present invention.
Figure 7B:
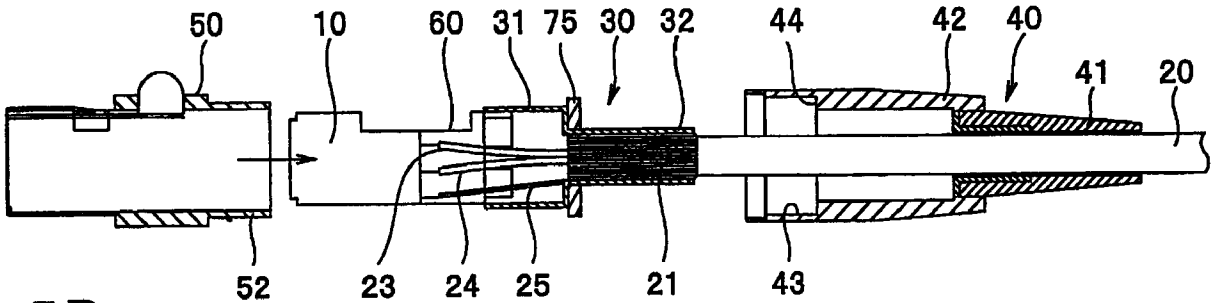
FIG. 7B is a longitudinal cross sectional view showing an assembly process following the step shown in FIG. 7A of Embodiment 3.
Figure 7C:
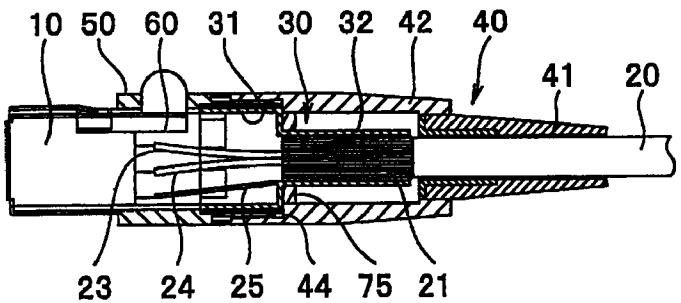
FIG. 7C is a longitudinal cross sectional view showing a state where the assembly of Embodiment 3 is completed.

Next, Embodiment 3 will be described. Most part of structure of Embodiment 3 is the same as that of Embodiment 1 except that a conductive cloth ring 75 shown in FIG. 7A, FIG. 7B, and FIG. 7C is incorporated therein in place of the conductive sleeve 70 in Embodiment 1. The conductive cloth ring 75 is the one formed in a ring shape by punching a material by pressing or the like, the material being formed in the form of a thick cloth by knitting conductive thin wires or without knitting, and the conductive cloth ring 75 has elasticity in the thickness direction as well as in the radial direction. The center hole of the conductive cloth ring 75 is fitted around the outer peripheral side of the small-diameter cylindrical part 32 of the crimping sleeve 30. The outer diameter of the conductive cloth ring 75 is larger than that of the large-diameter cylindrical part 31 of the crimping sleeve 30, and projects to the outer peripheral side beyond the outer peripheral face of the large-diameter cylindrical part 31.

As described concerning Embodiment 1, the female connector 10, the insulating sleeve 60, the large-diameter cylindrical part 31 of the crimping sleeve 30, and the rear end outer circumference 52 (see FIG. 7B) of the connector housing 50 covering the conductive sleeve 70 are fitted in the front end inner circumference 43 of the bush 40 to integrate the connector housing 50 with the bush 40. While the connector housing 50 and the bush 40 are integrated, a rear end face 51 of the connector housing 50 is in contact with a step 44 that is continuously formed from the front end inner circumference 43 of the bush 40. Accordingly, a relative positional relation between the connector housing 50 and the bush 40 is determined, and the outer peripheral edge of the conductive cloth ring 75 projecting to the outer peripheral side beyond the peripheral face of the large-diameter cylindrical part 31 of the crimping sleeve 30 is sandwiched between the rear end face 51 of the connector housing 50 and the step 44 of the bush 40. Moreover, the step 44 of the bush 40 presses the conductive cloth ring 75 against the step between the large-diameter cylindrical part 31 and small-diameter cylindrical part 32 of the crimping sleeve 30. Since the conductive cloth ring 75 has elasticity, the conductive cloth ring 75 is interposed while keeping repulsion by being pressed between the connector housing 50 and the bush 40 as well as between the crimping sleeve 30 and the bush 40, and the conductive cloth ring 75 connects the connector housing 50, the crimping sleeve 30, and the bush 40 electrically reliably.

In this way, since the conductive cloth ring 75 having elasticity connects the connector housing 50 to the crimping sleeve 30 electrically reliably at a number of points also in Embodiment 3, the connection from the shield outer jacket of the microphone cable 20 to the connector housing 50 is made electrically reliably and there is no opening (open portion) of the shield, thus allowing the shield effect of the microphone connector to be increased. Moreover, even if the dimension error exists between the connector housing 50 and the crimping sleeve 30, because the conductive cloth ring 75 having elasticity is interposed therebetween, the electrical connection between the both will not be cut off by looseness between the connector housing 50 and the crimping sleeve 30, thus allowing noise generation to be prevented.

INDUSTRIAL APPLICABILITY

Although the illustrated embodiments are configured assuming a condenser microphone, the present invention can be applied to any type of microphone. The connector according to the present invention can be applied for the connection between a microphone and a microphone code, the connection between a dedicated microphone cable connecting a microphone unit part to a power module part and the above-described microphone unit part, and also the connection between the above-described dedicated microphone cable and power module part.

What is claimed is:

1. A microphone connector, comprising:

a microphone cable including a shield outer jacket that is put on an outside of a core wire, and an insulating coating for covering the shield outer jacket;

a cable side connector to which the core wire and shield outer jacket of the microphone cable are connected, and which can couple a microphone side connector;

a connector housing that covers the cable side connector; and a crimping sleeve made of shield material including a small-diameter cylindrical part and a large-diameter cylindrical part, wherein the microphone cable includes a fold-back part that is folded back so that the shield outer jacket covers an outer surface of the insulating coating at a connection end portion with the connector;

the small-diameter cylindrical part of the crimping sleeve is fitted around an outer peripheral side of the fold-back part of the shield jacket at an end portion of the microphone cable and is compressed to couple the crimping sleeve with the microphone cable;

the large-diameter cylindrical part of the crimping sleeve is put on a connection portion between the cable side connector and the microphone cable; and the large-diameter cylindrical part of the crimping sleeve and the connector housing engage each other via a capacitor sleeve in which a metal face is formed on the right side and rear side of a plastic film having a wave-form-shaped longitudinal cross section, respectively.

2. The microphone connector according to claim 1, wherein in the capacitor sleeve, a part of a cylinder is removed so as to form a cross sectional shape in a C-shape.

3. A method of shielding a microphone connector, the microphone connector comprising:

a microphone cable including a shield outer jacket that is put on an outside of a core wire, and an insulating coating for covering the shield outer jacket;

a cable side connector to which the core wire and shield outer jacket of the microphone cable are connected, and which can couple a microphone side connector;

a connector housing that covers the cable side connector; and a crimping sleeve made of shield material including a small-diameter cylindrical part and a large-diameter cylindrical part, the method comprising the steps of:

folding back the shield outer jacket of the microphone cable so as to cover an outer surface of the insulating coating at a connection end portion with the connector and thereby forming a fold-back part;

fitting the small-diameter cylindrical part of the crimping sleeve around an outer peripheral side of the fold-back part of the shield outer jacket at an end portion of the microphone cable and compressing the same and thereby coupling the crimping sleeve with the microphone cable;

putting the large-diameter cylindrical part of the crimping sleeve on a connection portion between the cable side connector and the microphone cable; and engaging the large-diameter cylindrical part of the crimping sleeve with the connector housing via a conductive sleeve made of elastic material and having a waveform-shaped longitudinal cross section.

4. A method of shielding a microphone connector, the microphone connector comprising:

a microphone cable including a shield outer jacket that is put on an outside of a core wire, and an insulating coating for covering the shield outer jacket;

a cable side connector to which the core wire and shield outer jacket of the microphone cable are connected, and which can couple a microphone side connector;

a connector housing that covers the cable side connector; and a crimping sleeve made of shield material including a small-diameter cylindrical part and a large-diameter cylindrical part, the method comprising the steps of:

folding back the shield outer jacket of the microphone cable so as to cover an outer surface of the insulating coating at a connection end portion with the connector and thereby forming a fold-back part;

fitting the small-diameter cylindrical part of the crimping sleeve around an outer peripheral side of the fold-back part of the shield outer jacket at an end portion of the microphone cable and compressing the same and thereby coupling the crimping sleeve with the microphone cable;

putting the large-diameter cylindrical part of the crimping sleeve on a connection portion between the cable side connector and the microphone cable; and engaging the large-diameter cylindrical part of the crimping sleeve with the connector housing via a capacitor sleeve in which a metal face is formed on the right side and rear side of a plastic film having a waveform-shaped longitudinal cross section, respectively.

5. A method of shielding a microphone connector, the microphone connector comprising:

a microphone cable including a shield outer jacket that is put on an outside of a core wire, and an insulating coating for covering the shield outer jacket;

a cable side connector to which the core wire and shield outer jacket of the microphone cable are connected, and which can couple a microphone side connector;

a connector housing that covers the cable side connector; and a crimping sleeve made of shield material including a small-diameter cylindrical part and a large-diameter cylindrical part, the method comprising the steps of:

folding back the shield outer jacket of the microphone cable so as to cover an outer surface of the insulating coating at a connection end portion with the connector and thereby forming a fold-back part;

fitting the small-diameter cylindrical part of the crimping sleeve around an outer peripheral side of the fold-back part of the shield outer jacket at an end portion of the microphone cable and compressing the same and thereby coupling the crimping sleeve with the microphone cable;

putting the large-diameter cylindrical part of the crimping sleeve on a connection portion between the cable side connector and the microphone cable; and compressing and interposing an elastic conductive cloth ring between the crimping sleeve and the connector housing.

* * * * *